US006972059B1

(12) United States Patent
Skerdi

(10) Patent No.: US 6,972,059 B1
(45) Date of Patent: Dec. 6, 2005

(54) EXOTHERMIC FEEDER

(75) Inventor: Udo Skerdi, Bendorf (DE)

(73) Assignee: AS Lungen GmbH & Co. KG, Bendorf (DE)

( * ) Notice: Subject to any disclaimer, the term of this patent is extended or adjusted under 35 U.S.C. 154(b) by 0 days.

(21) Appl. No.: 10/009,537

(22) PCT Filed: May 20, 2000

(86) PCT No.: PCT/EP00/04597

§ 371 (c)(1),
(2), (4) Date: Mar. 12, 2002

(87) PCT Pub. No.: WO00/73236

PCT Pub. Date: Dec. 7, 2000

(30) Foreign Application Priority Data

Jun. 1, 1999 (DE) ..... 199 25 167

(51) Int. Cl.[7] ..... C06B 33/04

(52) U.S. Cl. ..... 149/43; 149/41; 149/61; 75/303; 75/305; 164/53

(58) Field of Search ..... 149/37, 43, 44, 149/41, 61; 75/303, 305; 164/53

(56) References Cited

U.S. PATENT DOCUMENTS

| | | | | |
|---|---|---|---|---|
| 2,500,097 | A * | 3/1950 | Soffel | 149/41 |
| 2,798,818 | A * | 7/1957 | Diran et al. | 106/38.35 |
| 3,162,558 | A * | 12/1964 | Bishop et al. | 149/2 |
| 3,326,273 | A * | 6/1967 | Ruddle et al. | 164/349 |
| 3,582,369 | A * | 6/1971 | Nouveau | 106/38.22 |
| 3,923,526 | A * | 12/1975 | Takashima | 106/38.22 |
| 3,953,219 | A * | 4/1976 | Takashima | 106/38.27 |
| 3,982,929 | A * | 9/1976 | Heck et al. | 75/315 |
| 4,008,109 | A | 2/1977 | Norton | |
| 4,081,168 | A * | 3/1978 | Atterbury | 249/106 |
| 4,119,468 | A * | 10/1978 | Wiley | 149/43 |
| 4,201,606 | A | 5/1980 | Neat | |
| 4,665,968 | A * | 5/1987 | Scherer | 164/360 |
| 4,694,884 | A * | 9/1987 | Butler et al. | 164/359 |
| 4,767,800 | A * | 8/1988 | Neu et al. | 523/141 |
| 4,880,483 | A * | 11/1989 | Baldi | 149/44 |
| 5,180,759 | A * | 1/1993 | Neu et al. | 523/141 |
| 5,370,370 | A * | 12/1994 | Benson | 266/236 |
| 5,632,326 | A * | 5/1997 | Gough | 164/529 |
| 6,133,340 | A * | 10/2000 | Menon | 523/139 |

FOREIGN PATENT DOCUMENTS

| | | |
|---|---|---|
| GB | 2124527 | 2/1984 |
| WO | WO 80/02811 | 12/1980 |

* cited by examiner

*Primary Examiner*—Jeffrey L. Gellner
(74) *Attorney, Agent, or Firm*—Scott R. Cox

(57) ABSTRACT

An exothermal feeder mass is described, containing aluminum and magnesium, at least one oxidizing agent, a $SiO_2$-containing filler, and an alkali silicate as the binder; it is characterized in that it contains roughly 2.5 to 20% by weight of a reactive aluminum oxide with a specific surface of at least roughly 0.5 $m^2/g$ and an average particle diameter ($d_{50}$) from roughly 0.5 to 8 microns and is essentially free of fluoride-containing fluxes.

27 Claims, 1 Drawing Sheet

EXOTHERMIC FEEDER

BACKGROUND

The invention relates to an exothermal feeder mass containing aluminum and magnesium, at least one oxidizing agent, a temperature-resistant $SiO_2$-containing filler, and an alkali silicate as the binder.

PRIOR ART

In exothermal feeder masses aluminum is used to cause an exothermal reaction with the oxidizing agent. Known feeder masses also contain a reactive fluorine compound which reacts with a passivating oxide skin on the aluminum powder so that the latter can react with the oxidizing agents.

One such feeder mass is described in DE-C-25 32 745. It contains among other materials, aluminum powder, an unspecified aluminum oxide and an organic material (phenol resin, urea resin or furan resin, starch) or an inorganic binder (silica sol, colloidal aluminum oxide) and an oxidizing agent for the fine-particle metal. The use of alkali silicates as binders is not mentioned. The fluorine compounds, called "fluoride catalysts", such as cryolite, fluorspar or sodium silicofluoride are important. The proportion of the fluorine compound can be 0.1 to 20% by weight. According to the examples the proportion of the fluoride compound is between 1.0 and 2.0%.

The presence of the fluorine compound in the exothermal feeder mass reduces the starting reaction temperature of the aluminum. This function results, for example, from the fact that for the likewise described heat-insulating feeder mass without aluminum the proportion of the fluoride compound can decrease to 0%.

DE-A-29 23 393 mentions among other material, exothermal feeder masses with aluminum power, cryolite, iron oxide, sand and aluminum oxide fibers. The latter should be preserved as fibers.

DE-C-28 31 505 describes an exothermal feeder mass with an $Al_2O_3$ additive which can be construed as an inert filler. Alkali silicates are not used, but the addition of a fluoride-containing flux (cryolite) is always necessary. Magnesium is not used.

DD-60 121 describes an exothermal feeder mass based on aluminum with the addition of water glass and a fluoride-containing flux. Aluminum oxide is not mentioned.

Since for environmental and process-engineering reasons there is a need for a fluoride-free exothermal feeder mass, it has already been suggested that an exothermal feeder mass without active fluorine portions be made available. One such feeder mass contains not only aluminum, but also magnesium or an aluminum-magnesium alloy. The passivity caused by the oxide skin on the aluminum is overcome by the temperature which occurs when the magnesium burns so that the aluminum also reacts with the oxidizing agent, by which a higher temperature is reached overall. In doing so, unwanted reactions occur in the feeder mass.

It was found that for fluoride-free exothermal feeder masses which contain aluminum and magnesium and also fillers with high $SiO_2$ content and alkali compounds (for example, from water glass) as the binder and alkali nitrates as the oxidizing agent, a so-called "hollow fire" is formed which probably originates from vitrification of the $SiO_2$-containing fillers with the alkali compounds.

This hollow fire is evidenced by the formation of large cavities in the feeder wall which are connected by channels to the molten iron in the feeder. Iron losses occur due to penetration of the molten iron into these cavities. Moreover, this iron can only be separated from the reacted feeder mass with difficulty, so that it is almost impossible to re-process the iron.

The object of this invention is to reduce the so-called "hollow fire".

It has been found that surprisingly a hollow fire does not occur when a reactive or extremely finely ground aluminum oxide is added to the feeder mass.

Figure 1:
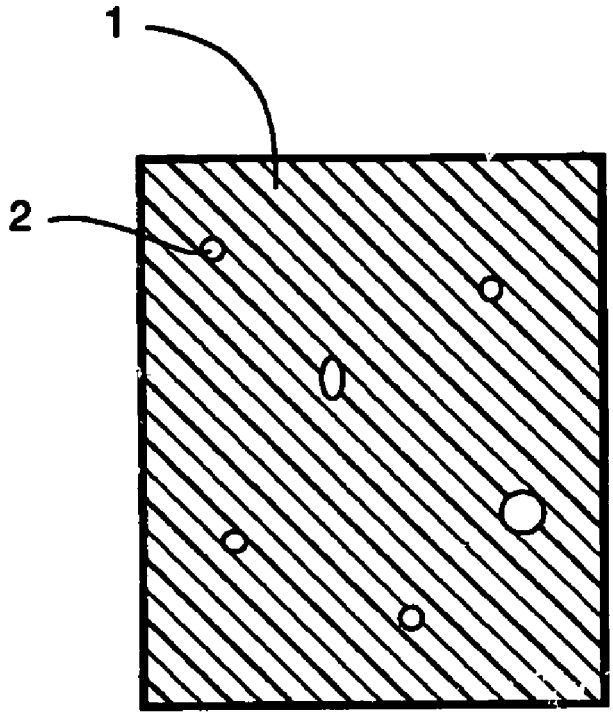
FIG. 1 is a cross-sectional view of a feeder composition showing a host of small cavities.

The subject matter of the invention is thus an exothermal feeder mass which contains about 2.5 to 20% by weight of a reactive aluminum oxide with a specific surface area of at least about 0.5 $m^2/g$ and an average particle diameter ($d_{50}$) from about 0.5 to 15 microns and which is essentially free of fluoride-containing fluxes.

The reactive aluminum oxide generally contains up to about 5% OH groups. When the proportion of OH groups is relatively low, reactivity is also achieved by the very small size of the aluminum oxide particles.

"Essentially free" is defined as having a fluoride content below 1.0, preferably below 0.5, most preferably below 0.1% by weight.

The exothermal feeder mass, as claimed in the invention after reaction, contains only small cavities which are not connected to one another by channels so that no iron from the feeder core can intrude.

It is believed that the reactive aluminum oxide reacts with the existing alkali compounds so that it can no longer react with the $SiO_2$-containing filler resulting in vitrification and cavity formation. When hollow fire no longer occurs, during and after the end of the reaction of the feeder mass, the strength of the mass also increases.

The reactive aluminum oxide in the feeder mass of the invention preferably has a specific surface area of about 1 to 10 $m^2/g$. Generally the composition of the feeder mass of the invention is as follows:

- Aluminum: 20–35% by weight, preferably 20–23% by weight
- Magnesium: 1.5–10% by weight, preferably 2–7% by weight
- Oxidizing agent: 8–20% by weight, preferably 10–15% by weight
- Reactive aluminum oxide: 4–18% by weight, preferably 8–13% by weight
- Alkali silicate: 8–22% by weight, preferably 10–13% by weight or 17–23% by weight
- $SiO_2$-containing filler: 58.5–17% by weight, preferably 43–29% by weight The preferred amounts of the alkali silicate depend on the filler that is chosen. For fillers with a smaller bulk density (for example, hollow microspheres) the preferred amount of the alkali silicate is higher.

The oxidizing agent, as in conventional feeder masses, is iron oxide and/or an alkali nitrate, such as sodium or potassium nitrate, or the reduction product of the latter (alkali nitrite or alkali oxide) reacting with the reactive aluminum oxide.

Preferably the $SiO_2$-containing filler has a $SiO_2$ content of at least 50% by weight, preferably more than 60% by weight.

The temperature-resistant $SiO_2$-containing fillers can be quartz, sand and/or aluminum silicates, in the latter case preferably hollow microspheres, ground chamotte and/or mineral fibers being used.

The reactive aluminum oxide preferably has the following properties:

| | |
|---|---|
| $Al_2O_3$ content | >90% |
| Content of OH-groups: | up to 5% (depending on the particle diameter) |
| Specific surface area (BET) | about 1 to 10 $m^2/g$ |
| Average particle diameter ($d_{50}$): | 0.5 to 15 microns |

The subject matter of the invention is also a process for reducing the hollow fire in essentially fluoride-free feeder masses. The process is characterized by a feeder mass as defined above being used.

It was furthermore found that when using the feeder mass of the invention, a change of the molten iron contained in the feeder mass, which change extends into the casting, surprisingly occurs. The basic metallic structure is changed such that degeneration of the solidified casting mass due to the formation of lamellar graphite is prevented and the desired spheroidal graphite is formed. This can possibly be attributed to the presence of magnesium in the feeder mass as a spherogenic additive, although it does not come directly into contact with the molten iron and therefore no interaction between the two could be expected. A reaction of the magnesium contained in the feeder mass with the molten iron in the vapor phase is not likely, as magnesium has an extremely low vapor pressure and the feeder mass contains air inclusions between the grains of fine-grain mineral, so that the vaporous magnesium would immediately react with atmospheric oxygen. The effect which can be achieved by the invention is probably due to the feeder mass containing impurities (for example, sulfur) which can diffuse without the magnesium in the feeder mass into the molten iron and in this way can react with the very small amounts of the spherogenic additive (for example, magnesium) in the molten iron, so that when the iron solidifies, lamellar graphite rather than spheroidal graphite forms. It is assumed that the magnesium in the feeder mass reacts with the impurities contained therein so that they can no longer diffuse into the molten iron. The magnesium therefore apparently has a "scavenger" function.

In addition to the magnesium, other spherogenic additives, such as cerium, can be used. Alkali metals or alkaline earth metals other than magnesium, for example, calcium, are not as well suited since they easily oxidize in air.

The subject matter of the invention is thus also a process for preventing graphite degeneration in the feeder neck area and in the area which extends into the casting. This process is characterized by a feeder mass as defined above being used.

The invention is explained by the following examples.

EXAMPLE 1

| Formulation: | |
|---|---|
| Aluminum (0.063–0.5 mm grain size) | 20% by weight |
| Sodium nitrate as oxidizing agent: | 15% by weight |
| Magnesium (0.1–0.5 mm grain size) | 4.5% by weight |

-continued

| Formulation: | |
|---|---|
| Reactive $Al_2O_3$: $Al_2O_3$ content 99%, BET surface < 6 $m^2/g$, $d_{50}$ 4–8 microns | 9% by weight |
| $SiO_2$ sand (0.1–0.5 mm grain size) | 40.5% by weight |
| Water glass (43–45% solution) | 11% by weight |

The components were thoroughly mixed, and a feeder mold was filled with the resulting mass. The feeder mold was gassed with carbon dioxide. The water glass reacted with the carbon dioxide resulting in the formation of colloidal silicic acid and sodium carbonate which hardened the feeder mass. Then the mass was dried until the weight is constant.

The feeder was placed on the casting model and thus rammed up, whereupon molten iron was poured into the mold. In doing so the feeder mass ignited as the temperature rises, the sodium carbonate obtained from the water glass and the reaction product of the sodium nitrate preferably reacted with the reactive $Al_2O_3$ so that the hollow fire which occurred during the reaction with sand was reduced. After the end of the casting process the feeder was removed. After the reaction the feeder (1) showed in cross section a host of small cavities (2) which were not interconnected by channels and thus which did not contain any iron either (FIG. 1).

EXAMPLE 2

| Formulation: | |
|---|---|
| Aluminum (as in example 1) | 20% by weight |
| Sodium nitrate (as in example 1) | 10% by weight |
| Magnesium (as in example 1) | 4% by weight |
| Reactive $Al_2O_3$ (as in example 1) | 12.5% by weight |
| $SiO_2$ hollow microspheres (0–0.5 mm grain size) bulk weight 350 $cm^3/g$, $SiO_2$ content 55–65%) | 36.5% by weight |
| Water glass (as in example 1) | 17% by weight |

The components were mixed with one another as in example 1, placed in a feeder mold, gassed with carbon dioxide, and dried. Casting was also carried out as in example 1. The cross section of the reacted feeder mass showed essentially the same pore structure as the feeder from example 1.

EXAMPLE 3

Comparison

The formulation was the same as in example 1, but instead of reactive $Al_2O_3$, 9% by weight $Al_2O_3$ with the following properties were used: $Al_2O_3$ content 99%, grain size 0 to 0.5 mm ($d_{50}$=200 microns).

Figure 2:
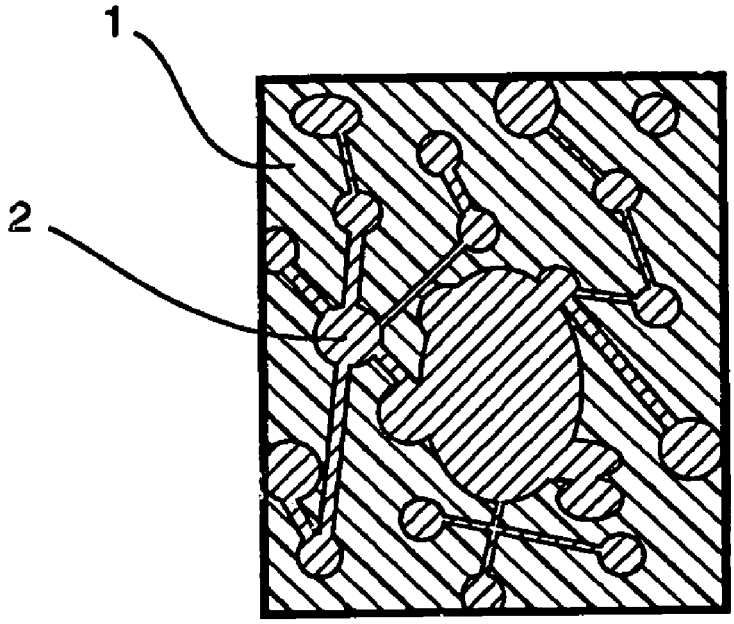
FIG. 2 is a comparison feeder composition disclosing large cavity volumes which are connected with channels.

Processing continued as in example 1. The resulting feeder (1) (see FIG. 2 for an extract from the feeder wall) after the reaction showed a major hollow fire with a large cavity volume in the center which was connected via channels to smaller cavities (2) which extended into the region of the molten iron. All the cavities were filled with solidified iron. When the feeder was crushed, residues of the reacted feeder mass adhered to the pieces of iron. The compressive strength of the conventionally produced cylindrical test piece (d=50 mm, h=50 mm) for quality control of the feeder mass from Example 3 was about 35% less than that of the test piece from Example 1.

What is claimed is:

1. An exothermal feeder mass comprising aluminum, magnesium, at least one oxidizing agent, a $SiO_2$-containing filler and an alkali silicate as a binder, wherein the mass further comprises about 2.5 to about 20 percent by weight of a reactive aluminum oxide with a specific surface area of at least about 0.5 $m^2/g$ and an average particle diameter ($d_{50}$) from about 0.5 to about 8 microns, and wherein the mass is essentially free of fluoride.

2. The feeder mass of claim 1 wherein the reactive aluminum oxide has a specific surface area of about 1 to about 10 $m^2/g$.

3. The feeder mass of claim 1 wherein the oxidizing agent comprises iron oxide.

4. The feeder mass of claim 1 wherein the oxidizing agent comprises an alkali nitrate.

5. The feeder mass of claim 1 wherein the $SiO_2$-containing filler has a $SiO_2$ content of at least about 50 percent by weight.

6. The feeder mass of claim 1 wherein the $SiO_2$-containing filler has a $SiO_2$ content of at least about 60 percent by weight.

7. The feeder mass of claim 1 wherein the $SiO_2$-containing filler is comprised of a material selected from the group consisting of quartz, sand and aluminum silicates and combinations thereof.

8. The feeder mass of claim 1 wherein the properties of the reactive aluminum oxide comprise the following:

an $Al_2O_3$ content greater than about 90 percent, a content of OH-groups up to about 5 percent, a specific surface area (BET) from about 1 to about 10 $m^2/g$, and an average particle diameter ($d_{50}$) from about 0.5 to about 15 microns.

9. A process for reducing hollow fire in an essentially fluoride-free feeder mass comprising preparing the feeder mass utilizing the compositions of claim 1.

10. A process for preventing graphite degeneration in a feeder neck area and in an area which extends into a feeder mass comprising casting the feeder mass using the composition of claim 1.

11. An exothermal feeder mass comprising about 20 to about 35 percent by weight aluminum, about 1.5 to about 10 percent by weight magnesium, about 8 to about 20 percent by weight of an oxidizing agent, about 4 to about 18 percent by weight of a reactive aluminum oxide, about 8 to about 22 percent by weight of an alkali silicate and about 58.5 to about 17 percent by weight of a temperature resistant $SiO_2$-containing filler, and wherein the massis essentially free of fluoride.

12. The feeder mass of claim 11 wherein the aluminum comprises from about 22 to about 28 percent by weight.

13. The feeder mass of claim 11 wherein the magnesium comprises from about 2 to about 7 percent by weight.

14. The feeder mass of claim 11 wherein the oxidizing agent comprises about 10 to about 15 percent by weight.

15. The feeder mass of claim 11 wherein the reactive aluminum oxide comprises about 8 to about 13 percent by weight.

16. The feeder mass of claim 11 wherein the alkali silicate comprises from about 10 to about 13 percent by weight.

17. The feeder mass of claim 11 wherein the alkali silicate comprises from about 17 to about 22 percent by weight.

18. The feeder mass of claim 11 wherein the temperature-resistant $SiO_2$-containing filler comprises from about 43 to about 29 percent by weight.

19. The feeder mass of claim 11 wherein the oxidizing agent comprises iron oxide.

20. The feeder mass of claim 11 wherein the oxidizing agent comprises an alkali nitrate.

21. The feeder mass of claim 11 wherein the temperature resistant $SiO_2$-containing filler has a $SiO_2$ content of at least about 50 percent by weight.

22. The feeder mass of claim 11 wherein the temperature resistant $SiO_2$-containing filler has a $SiO_2$ content of at least about 60 percent by weight.

23. The feeder mass of claim 11 wherein the temperature resistant $SiO_2$-containing filler is comprised of a material selected from the group consisting of quartz, sand and aluminum silicates and combinations thereof.

24. The feeder mass of claim 11 wherein the temperature resistant $SiO_2$-containing filler is formed in a shape selected from the group consisting of hollow microspheres, ground chamotte and mineral fibers and combinations thereof.

25. The feeder mass of claim 11 wherein the properties of the reactive aluminum oxide comprise the following:

an $Al_2O_3$ content greater than about 90 percent, a content of OH-groups up to about 5 percent, a specific surface area (BET) from about 1 to about 10 $m^2/g$, and an average particle diameter ($d_{50}$) from about 0.5 to about 15 microns.

26. A process for reducing hollow fire in an essentially fluoride-free feeder mass comprising preparing the feeder mass utilizing the compositions of claim 11.

27. A process for preventing graphite degeneration in a feeder neck area and in an area which extends into a feeder mass comprising casting the feeder mass using the composition of claim 11.

* * * * *